US006004372A

United States Patent [19]

Quets

[11] Patent Number: 6,004,372

[45] Date of Patent: Dec. 21, 1999

[54] THERMAL SPRAY COATING FOR GATES AND SEATS

[75] Inventor: John Quets, Indianapolis, Ind.

[73] Assignee: Praxair S.T. Technology, Inc., Danbury, Conn.

[21] Appl. No.: 09/238,440

[22] Filed: Jan. 28, 1999

[51] Int. Cl.[6] ..... B22F 1/00

[52] U.S. Cl. ..... 75/255

[58] Field of Search ..... 75/252, 255, 240, 75/242

[56] References Cited

U.S. PATENT DOCUMENTS

| | | | |
|---|---|---|---|
| 2,714,563 | 8/1955 | Poorman et al. | 117/105 |
| 2,972,550 | 5/1961 | Pelton | 117/21 |
| 3,035,934 | 5/1962 | Cape . | |
| 4,173,685 | 11/1979 | Weatherly | 428/556 |
| 4,507,151 | 3/1985 | Simm et al. | 75/251 |
| 4,556,607 | 12/1985 | Sastri | 428/627 |
| 4,814,234 | 3/1989 | Bird | 428/564 |
| 4,902,539 | 2/1990 | Jackson | 239/13 |
| 4,925,626 | 5/1990 | Anand et al. | 419/18 |
| 5,006,321 | 4/1991 | Dorfman et al. | 427/192 |
| 5,702,769 | 12/1997 | Peters | 427/451 |

OTHER PUBLICATIONS

R.C. Tucker, Jr., "Thermal Spray Coatings", *Surface Engineering ASM Handbook*, vol. 5, 1994, pp. 497–509.

*Primary Examiner*—Ngoclan Mai
*Attorney, Agent, or Firm*—Blake T. Biederman

[57] ABSTRACT

A thermal spray powder composition, a coating made using a powder of this composition, and a process for applying the coating. The chemical composition of the powders of the invention comprise a blend of a tungsten carbide-cobalt-chromium material and a metallic cobalt alloy.

8 Claims, No Drawings

THERMAL SPRAY COATING FOR GATES AND SEATS

FIELD OF THE INVENTION

The invention relates to a thermal spray powder composition, a coating made using a powder of this composition, and a process for applying the coating. The invention also relates to application of the coating to the wear surfaces of gate or ball valves and aircraft landing gear and to the surfaces of other components requiring wear resistance.

BACKGROUND OF THE INVENTION

This invention is related to the problem of providing wear resistant, low-friction surfaces on components operating under high stress and frequently in corrosive conditions. A variety of means have been used in attempts to satisfy these requirements including: the hardening of steel surfaces by heat treatment, carburizing, nitriding, or ion implantation; the use of solid ceramic or cermet components; the application of coatings produced by thermal spray, chemical vapor deposition, physical deposition, electroplating (particularly with chromium); and other techniques. Depending on the application, all of these approaches have limitations. A particularly difficult application is that of high pressure gate valves that open or close at high velocity in the oil and gas production industry. Another application that is difficult to satisfy is the coating of aircraft landing gear components where, in addition to the problems of wear and friction, the fatigue characteristics of the substrate are of particular concern. It is the intent of this invention to provide thermal spray coatings that can satisfy these and a wide variety of the other problems.

Gate valves consist of a valve body which is located axially in piping or tubing through which the fluid to be controlled flows. Within the valve body is a "gate" which is a solid, usually metallic, rectilinear plate component with a circular hole through it. The gate slides between two "seats" which are circular annulus metallic, ceramic, or cermet components with an inside diameter approximately equal to the diameter of the hole in the gate. The seats are coaxially aligned with and directly or indirectly attached to the ends of the pipe or tubing within which the valve is located. When the hole in the gate is aligned with the holes in the seats, the fluid flows freely through the valve. When the hole in the gate is partially or completely misaligned with seats the fluid flow is impeded or interrupted; i.e., the valve is partially or fully closed. To avoid leakage of the fluid, it is essential that the surfaces in contact between the gate and the seats be very smooth and held tightly together. Valves may have springs or other devices within them to hold the seats firmly against the gate. When the valve is closed, the fluid pressure on the upstream side of the valve also presses the gate against the seat on downstream side.

Gate valves are usually operated by sliding the gate between the seats using an actuator attached to the gate with a rod or shaft called a "stem". Using a manual actuator results in a relatively slow gate movement, a hydraulic actuator results in a more rapid gate movement, and a pneumatic actuator usually results in a very rapid gate movement. The actuator must be able to exert enough force to overcome the static and dynamic friction forces between the seats and the gate. The friction force is a function of the valve design and the force of the fluid in the pipe when the valve is closed. This friction force can become extremely high when the fluid pressure becomes very high. Adhesive wear of the seats and/or the gate that can occur when the valve is opened and closed can also be a problem and become excessive under high-pressure conditions. An additional potential problem is that of corrosion. The oil and gas from many wells may contain very corrosive constituents. Thus, for many wells, the valves must be made of corrosion resistant materials, particularly the seats and gate where corrosion of the surfaces exacerbates the wear and friction problems.

For manually operated valves at low pressure, hardened steel seats and gates may be sufficient to combat the wear and friction problems. For pneumatic and hydraulic valves at higher pressures, thermally sprayed coatings, such as tungsten carbide or chromium carbide based coatings on both the gate and seat surfaces may be sufficient. Three of the best coatings of this type are the detonation gun coatings UCAR LW-15, a tungsten carbide-cobalt-chromium coating, UCAR LW-5, a tungsten carbide-nickel-chromium coating, and UCAR LC-1C, a chromium carbide + nickel-chromium coating. For some applications, the use of a solid cobalt base alloy, Stellite 3 or 6, for the seats with a hardened steel gate may be adequate. Other approaches have included laser or plasma transfer arc overlays of Stellite 6 and spray and fused alloys.

As wells became deeper, the pressures increased and the methods described above became inadequate. Two new coatings were developed that have become the benchmarks of the industry. One is UCAR LW-26, a tungsten carbide based coating, described more fully in U.S. Pat. No. 4,173,685. This coating is usually applied by plasma spray followed by a heat treatment. It has outstanding performance characteristics, but is relatively expensive to produce. The other is UCAR LW-45, a tungsten carbide-cobalt-chromium detonation gun coating with a unique microstructure which is able to perform well in most of the harsh conditions of present day oil and gas wells. However, as wells are drilled even deeper and the pressures became even higher, even these benchmark coatings can not satisfy the requirements for these extreme conditions, and there is no other solution available today.

Often coatings must be used for wear resistance on components that are very sensitive to fatigue. An example is the cylinder in an aircraft landing gear cylinder. Any coating that would crack under the tensile stresses imposed on the cylinder due to a bending moment during operation could propagate into the cylinder and cause a fatigue failure of the cylinder with disastrous results. The present coating on the cylinder is electroplated hard chromium, which has a negative effect on fatigue that must be compensated for with an excessively thick cylinder wall. The chromium plating runs against an aluminum-nickel-bronze bushing or bearing, so any replacement for the chromium plating must have good mating (adhesive wear) characteristics with this material as well. In addition, any coating must have good abrasion resistance in the event sand or other hard particles become trapped in the bearing. The presently used chromium electroplate is only marginally adequate. It should also be noted that electroplating of chromium has very undesirable environmental characteristics, and it would be advantageous to replace it in this and other applications. An alternative to the present system of a hard coating on the cylinder running against a relatively soft bushing or bearing surface would be to have both surfaces coated with a hard coating. This system would resist abrasion, but the coated surfaces must also have a low friction and be resistant to adhesive wear when running against each other.

The fatigue effects of a coating have often been related to the strain-to-fracture (STF) of the coating; i.e., the extent to which a coating can be stretched without cracking. STF has, in part, been related to the residual stress in a coating. Residual tensile stresses reduce the added external tensile stress that must be imposed on the coating to crack it, while residual compressive stresses increase the added tensile stress that must be imposed on the coating to crack it. Typically, the higher the STF of the coating, the less of a negative effect the coating will have on the fatigue characteristics of the substrate. This is true because a crack in a well-bonded coating may propagate into the substrate, initiating a fatigue crack and ultimately a fatigue failure. Unfortunately, most thermal spray coatings have very limited STF, even if they are made of pure metals which would normally be expected to be very ductile and easily plastically deform rather than crack.

Thermal spray coatings produced with low or moderate particle velocities during deposition typically have a residual tensile stress which can lead to cracking or spalling of the coating if it becomes excessive. Residual tensile stresses also usually lead to a reduction in the fatigue properties of the coated component by reducing the STF of the coating. Some coatings made with high particle velocities, particularly detonation gun and Super D-Gun coatings with very high particle velocities during deposition can have moderate to highly compressive residual stresses. This is especially true of tungsten carbide based coatings. High compressive stresses can beneficially affect the fatigue characteristics of the coated component. High compressive stresses can, however, lead to chipping of the coating when trying to coat sharp edges or similar geometric shapes. Thus it can be difficult to take advantage of the superior physical properties such as hardness, density, and wear resistance of the detonation gun and Super D-Gun coatings when coating such configurations.

SUMMARY OF THE INVENTION

Now, according to the present invention, coatings are provided that satisfy the wear and corrosion resistance requirements for many applications including, but not limited to the examples just described gate and ball valve components and aircraft landing gear components. In addition to wear and corrosion resistance, these coatings must also have low residual stress and high STF to have little or no effect on the fatigue properties of the coated components and to make it possible to produce thick coatings and to coat complex shapes.

The present invention is based on the discovery that a thermally sprayed coating of a blend of a tungsten carbide-cobalt-chromium material and a metallic cobalt alloy provides the low friction and superior wear and corrosion resistance required for gate valves operating at very high pressure with pneumatic actuators, for aircraft landing gear cylinders, and many other applications. The coatings deposited must not only have excellent friction, wear, and corrosion characteristics, they must have a very high bond strength on a variety of metallic substrates and must have a relatively low residual stress. Any thermal spray deposition process that generates adequate particle velocities to yield a well-bonded, dense coating can to used.

The coatings of this invention are produced by thermal spray deposition. It is well known that when materials are thermally sprayed they are rapidly quenched on the substrate. This may result in the formation of metastable crystallographic phases or even amorphous materials in some cases. For example, an alpha alumina powder is usually completely melted during the spraying process and then is deposited as a mixture of gamma, alpha, and other phases. Minor compositional changes may also occur during the thermal spray process as a result of reaction with gases in the environment or the thermal spray gases or as a result of differential evaporation of one of the constituents of the material being sprayed. Most often the reaction is one of oxidation from exposure to air or carburization if a fuel gas is used as in detonation gun deposition or high velocity oxy-fuel deposition. A more complete discussion of thermal spray deposition can be found in the following publications: Thermal Spray Coatings, R. C. Tucker, Jr., in Handbook of Deposition Technologies for Films and Coatings, Second Edition, R. F. Bunshah, ed., Noyes Publications, 1994, pp. 591 to 639; Thermal Spray Coatings, R. C. Tucker, Jr., in Surface Engineering ASM Handbook Volume 5, 1994, ASM International, pp. 497 to 509; M. L. Thorpe, Journal of Thermal Spray Technology, Volume 1, 1992, pp. 161 to 171.

One of the primary constituents of the coatings of this invention is tungsten carbide. Most tungsten carbide powders used in thermal spray are either WC or a combination of WC and $W_2C$. Other phases may be present. The tungsten carbides are most often combined in the powder with some amount of cobalt to facilitate melting and to add cohesive strength to the coatings. Occasionally chromium is also added for corrosion resistance or other purposes. As examples, the cobalt or cobalt plus chromium may be simply combined with the carbide in a spray dried and sintered powder with most of the cobalt or cobalt plus chromium still present as metallics. They may also be combined with the carbide in a cast and crushed powder with some of the cobalt or cobalt plus chromium reacted with the carbide. When thermally sprayed, these materials may be deposited in a variety of compositions and crystallographic forms. As used herein, the terms tungsten carbide or WC shall mean any of the crystallographic or compositional forms of tungsten carbide. The terms tungsten carbide cobalt, tungsten carbide-cobalt-chromium, WC—Co or WC—Co—Cr shall mean any of the crystallographic or compositional forms of the combinations of tungsten carbide with cobalt or cobalt plus chromium. Another of the constituents of the coatings of this invention is a cobalt alloy. As used herein, the term cobalt alloy shall include any of the crystallographic forms of any cobalt alloy.

DESCRIPTION OF PREFERRED EMBODIMENTS

The chemical composition of the powders of the invention comprise a blend of a tungsten carbide-cobalt-chromium material and a metallic cobalt alloy. Note that all compositions herein are in weight percent not including unavoidable trace contaminants. Preferably the tungsten carbide-cobalt-chromium material comprises tungsten carbide-5 to 20 cobalt and 0 to 12 chromium, most preferably about 8 to 13 cobalt and 0 or 4 to 10 chromium. The metallic alloy is preferably a cobalt alloy with a composition which comprises in weight percent 27 to 29 chromium, 7 to 9 tungsten, 0.8 to 1.2 carbon, and balance cobalt—particularly preferred is a cobalt alloy having the nominal composition comprising cobalt-28 chromium-8 tungsten-1 carbon (nominally Stellite 6); or, a composition which comprises in weight percent 25 to 31 molybdenum, 14 to 20 chromium, 1 to 5 silicon, less than 0.08 carbon, and balance cobalt—particularly preferred is a cobalt alloy having the nominal composition cobalt-28 molybdenum-17 chromium-3 silicon-less than 0.08 carbon (nominally Tribaballoy 800). Preferably the blend comprises 5 to 35 metallic cobalt alloy, most preferably 10 to 30 metallic cobalt alloy. The tungsten carbide-cobalt-chromium material is preferably made by the cast and crush powder manufacturing technique when the chromium content is approximately zero and by a sintering process when the chromium content is 2 to 12. The metallic cobalt alloy is preferably produced by vacuum melting and inert gas atomizing. If a detonation gun deposition process is to be used to produce the coating, the tungsten carbide-cobalt powder should preferably be sized to less than 325 U.S. standard screen mesh (44 micrometers) and the metallic cobalt alloy sized to less then 270 mesh (60 micrometers), but greater than 325 mesh (44 micrometers) by screening. If other thermal spray deposition techniques are to be used, the powders should be sized appropriately.

The invention further is a process for producing a low friction, wear and corrosion resistant coating comprising the steps:

a) forming powder feed composition comprising a blend of a tungsten carbide-cobalt material and a metallic cobalt alloy; and b) thermally depositing, preferably with a particle velocity greater than 500 m/sec, said powder feed of step a) onto a component forming a coating comprising a tungsten carbide-cobalt blended with a metallic cobalt alloy.

Blending of the WC—Co—Cr material and the cobalt alloy is usually done in the powder form prior to loading it into the powder dispenser of the thermal spray deposition system. It may, however, be done by using a separate powder dispenser for each of the constituents and feeding each at an appropriate rate to achieve the desired composition in the coating. If this method is used, the powders may be injected into the thermal spray device upstream of the nozzle, through the nozzle or into the effluent downstream of the nozzle.

Any thermal spray deposition process that generates a sufficient powder velocity (generally greater than about 500 meters/second) to achieve a well bonded, dense coating microstructure with a high cohesive strength can be used to produce the coatings of this invention. The preferred thermal spray technique is the detonation gun process (for example, as described in U.S. Pat. Nos. 2,714,563 and 2,972,550) with a particle velocity greater than about 750 m/s, and most preferably the Super D-gun process (for example, as described in U.S. Pat. No. 4,902,539), with a particle velocity greater than about 1000 m/s. The later process produces a somewhat denser, better bonded coating with higher cohesive strength that is smoother as-deposited than the former. Both produce coatings with very high bond strengths and greater than 98 percent density, measured metallographically. Alternative methods of thermal spray deposition may include plasma spray deposition, high velocity oxy-fuel, and high velocity air-fuel processes.

The invention also comprises components having a wear resistant coating of this invention including, but not limited to, gate or ball valves in which the seats and/or the ball or gate sealing surfaces are coated and aircraft landing gear components in which the cylinders or their mating surfaces (bushings or bearings) are at least partially coated, said coating being a low-friction, wear, and corrosion resistant coating comprising a blend of a tungsten carbide-cobalt-chromium material and a metallic cobalt alloy.

The following examples are provided to further describe the invention. The examples are intended to be illustrative in nature and is not to be construed as limiting the scope of the invention.

EXAMPLE 1

A laboratory wear test has been developed to evaluate materials for use in gate valves as seat or gate materials or coatings. A plate that is about 152 mm long, 76 mm wide, and 13 mm thick represents the gate. Three pins that are about 6.35 mm in diameter represent the seats. Either the plate or the pins may be made of the same solid material that seats and gates would be made of or they may be coated on their mating surfaces (a 76×152 mm face of the plate or the flat ends of the pins). The pins are held in a fixture that insures that one end of each pin is held against the plate in an annular array with a diameter of about 75 mm with equal pressure of 112.47 MPa (16,300 psi) on each pin. The fixture is then oscillated through an arc of about 100 degrees. Sensors allow the calculation of the velocity of the pins and the coefficient of dynamic friction. Each oscillation is considered a cycle. The pins and plate are evaluated periodically during the test. The test duration is typically 25 cycles. The evaluation of wear resistance is usually done qualitatively in this test based on the general appearance of the wear scars on both the pins and the plate. A numerical value is obtained for the dynamic coefficient of friction, but it is considered a relative value, specific to this test. The velocity of the pins relative to the plate that is achieved in the test is an indication of the friction force and general roughness due to wear. Thus the higher the velocity achieved, the lower the friction force and smoother the surfaces remain.

A correlation between laboratory test results and performance in actual production or field use is necessary in using such a test to screen materials for field use. The performance of cast Stellite 3 seats running against gates coated with UCAR LW-45 is well established in the field. This coupling has, therefore, been used as a benchmark in the laboratory test. An additional benchmark is that of UCAR LW-45 coatings on both the pins and the plate, since this coupling is considered to be the current benchmark of the industry in service.

A number of steel plates were coated with the detonation gun coating UCAR LW-45, then ground and lapped to thickness of 100 to 200 micrometers (0.004 to 0.008 inch) and a surface roughness of less than 8 micrometers Ra. A number of steel pins were coated with UCAR LW-45, UCAR LC-1C, a Super D-Gun coating of Stellite 6 alloy (SDG Stellite 6), and a Super D-Gun coating of this invention designated SDG A herein. The specific compositions of these materials were as follows:

| | |
|---|---|
| Stellite 3 casting | Co— 30.5_ Cr— 12.5_ W |
| UCAR LW-45 | WC—10Co—5Cr |
| UCAR LC-1C | Chromium carbide—20 (Ni—20Cr) |
| SDG Stellite 6 | Co—28Cr—8W—1C |
| SDG A | WC—9Co + 25(Co—28Cr—8W—1C) |

The coatings on the pins and the cast Stellite 3 pins were also ground and lapped to a coating thickness of 100 to 200 (0.004 to 0.008 inch) micrometers and a surface roughness of less than 8 micrometers Ra.

The laboratory test was run using these pin materials against the plates coated with UCAR LW-45 with the results shown in the following table.

| | Friction | | |
|---|---|---|---|
| Pin Material | Velocity | Value | Wear |
| Cast Stellite 3 | 100 | 2.3 | Baseline—Moderate |
| | 100 | 2.1 | Baseline—Moderate |
| UCAR LW-45 | 180 | 1.8 | Baseline |
| | 160 | 1.9 | Baseline |

-continued

| Pin Material | Friction | | |
|---|---|---|---|
| | Velocity | Value | Wear |
| SDG Stell 6 | 150 | 2.1 | Similar to Baseline |
| UCAR LC-1C | 170 | 2.1 | Baseline |
| SDG A | 160 | 1.3 | <<Baseline—slight |
| | 200* | 0.5* | <<Baseline—slight |

*the plate was somewhat smoother in this trial

The velocity measurement is in ft/sec. Both the velocity measurement and relative dynamic coefficient of friction value shown in the table are approximate average values for the 12 through the 25 cycles, representing the stabilized behavior of the wear couple. It is evident that the Super D-Gun Stellite 6 coating performed better than the baseline coating in this test. However, the new coating of this invention, SDG A, performed far better than both the baseline and Stellite 6 coatings.

EXAMPLE 2

A common test for the corrosion resistance of materials is a salt spray test defined by a standard of the American Society for Testing and Materials, ASTM B 117. In this test the samples are exposed to a salt spray fog for a period of 30 days at a temperature of 33.3 to 36.7 C (92 to 97 F). The performance of a coating of this invention, SDG A described in Example 1, was evaluated by coating AISI 4140 steel sample that was 76 mm wide, 127 mm long, and 12.5 mm thick on most of one 76×127 mm face. A portion of the face was left uncoated to simulate the cut-off or masking line present on many valve gates. Two thickness' of coatings were applied. The coatings were then sealed using an epoxy based sealant.

Finally, the coatings were ground to a thickness of either 100 to 130 micrometers, representing the typical thickness on a new part, or to a thickness of 250 to 280 micrometers, representing the thickness on a reworked part. The samples were then submitted to the test. After the 30 day exposure, the samples were cleaned and examined. There was no evidence of general, pitting, or crevice corrosion of the coating. In contrast, the uncoated areas of the steel were heavily corroded, as was to be expected.

While the preceding salt spray test is very useful in screening materials for many corrosive applications, it does not adequately represent those situations where a significant amount of hydrochloric acid is present. In these situations, the cobalt base alloy used in SDG A may be attacked. A better choice in these situations may be a coating similar to SDG A, but with the WC-Co material modified to include 4 to 12 Cr or a coating comprising WC—Co—Cr+25(Co-28Mo-17Cr-3Si-<0.08C).

EXAMPLE 3

The abrasive wear resistance of materials is frequently characterized using a dry sand "rubber" wheel test ASTM G 65–94. This test is useful in relatively ranking materials for their resistance to abrasive wear in applications such as seals or bearings where abrasive particles may become embedded in the seal or bearing surface. Thus the results of the test may be useful in selecting materials for aircraft landing gear cylinders where sand or other hard particles may be entrapped in the bronze bearing surface. Six detonation gun coatings of this invention were applied to AISI 1018 steel test samples using a single powder with a composition of WC-9Co+25(Co-28Cr-8W-1C). The microstructures and mechanical properties of the coatings were varied somewhat by varying the deposition parameters. The coatings were designated SDG B, C, D, E, F, and G. The wear tests were run at a velocity of 144 m/min under a load of 130 N (30 lb) for 3000 revolutions of the wheel which had a polyurethane outer layer in contact with the coated test sample. Ottawa silica sand with a nominal size of 212 micrometers (0.0083 inch) was fed to the nip between the wheel and the test sample. The wear scars were measured by weight loss of the coated sample converted to volume loss and reported as an average loss per 1000 revolutions.

| Coating | Scar Vol., mm3/1000 rev. |
|---|---|
| SDG B | 3.61 |
| SDG C | 3.69 |
| SDG D | 4.83 |
| SDG E | 4.85 |
| SDG F | 4.96 |
| SDG G | 4.69 |
| UCAR LW-45 | 1.5 |
| UCAR LC-1C | 3.88 |
| Plasma Sprayed WC—Co | 5.6 |
| Electroplated Cr | 8 to 10 |

It is evident that the coatings of this invention have an abrasive wear resistance that is substantially greater than that of electroplated hard chromium. Thus they should be excellent replacements, on this basis, for electroplated hard chromium in applications such as the coatings on cylinders in aircraft landing gear if other constraints are met. In this test the coatings of this invention have less wear resistance than that of the detonation gun coating UCAR LW-45, but that is to be expected because of the higher volume fraction of tungsten carbide in the UCAR LW-45. Surprisingly, they have substantially greater resistance than the plasma sprayed analog of UCAR LW-45. They are comparable in wear resistance to the detonation gun chromium carbide coating UCAR LC-1C.

EXAMPLE 4

The residual stress characteristics of the coatings of this invention described in Example 3 were assessed and compared with other coatings by coating Almen strips and measuring their deflections. The test is a modification of that described in the US Military Specification for shot peening Mil F-13165B. A positive deflection indicates a tensile residual stress in the coating, while a negative value indicates a compressive stress. The Almen test samples were made of AISI 1070 steel heat treated to a hardness of HRA 72.5 to 76 They were 76.2×19.05×0.79 mm (3×0.75×0.031 inches) coated on one 76.2×19.05 mm face with a coating about 300 mm thick. The strain-to-fracture (STF) of the coatings were assessed by coating AISI 4140 steel bars 25.4×1.27×0.635 cm (10×0.5×0.25 inches) heat treated to HRC 40 on one 25.4×1.27 cm face to a thickness of 300 micrometers and then bending the bars in a four point bend test fixture. The initiation of fracture was detected with a sonic sensor attached to the bar. The STF is a unit-less value reported in mils/inch or tenths of a percent.

| Coating | Almen, mils | STF, mils/in. |
|---|---|---|
| SDG B | +1.0 | 3.7 |
| SDG C | −7.0 | 5.4 |
| SDG D | −7.0 | 5.7 |

-continued

| Coating | Almen, mils | STF, mils/in. |
|---|---|---|
| SDG E | −2.5 | 4.6 |
| SDG F | −9.5 | 5.9 |
| SDG G | −9.0 | 5.8 |
| SDG WC—15Co | −24.5 | 6 |
| SDG WC—10Co | −6.5 | 2.8 |
| D-Gun WC—15Co | −1.6 | 2.8 |

First consider the Almen deflection data as an indication of residual stress. It is apparent that the residual stresses in the coatings of this invention are quite low and can be changed from very slightly tensile to somewhat compressive by changing the deposition parameters, at least when using Super D-Gun deposition. This implies that coating complex shapes such as sharp edges should not be a problem and that thick coatings can be deposited without cracking or spalling. Next consider the STF data which is an indicator of the effect of the coating on the fatigue properties of the substrate; i.e., a high STF is generally an indication that the coating will have little effect on the fatigue properties of the substrate. Note that the D-Gun WC-15Co coating has a low STF (even though it has a very low compressive residual stress) and is known to have a significant detrimental effect on the fatigue properties of steel, aluminum, and titanium substrates. The Super D-Gun WC-10Co coating has a somewhat higher compressive residual stress, but no better STF. The Super D-Gun WC-15Co coating has a significantly higher STF and is known to have very little or no effect on the fatigue properties of steel, aluminum, or titanium substrate. However, this is achieved only with a very high compressive residual stress, which makes coating complex shapes or thick coatings difficult. In contrast, the coatings of this invention can be deposited under conditions that yield coatings with a high STF and relatively low residual compressive stress. This suggests that the coatings will have little effect on the fatigue properties of the substrate and still be able to be applied to complex shapes and quite thick without difficulty. These attributes should make them very useful on components sensitive to fatigue such as aircraft landing gear components.

Various other modifications of the disclosed embodiments, as well as other embodiments of the invention, will be apparent to those skilled in the art upon reference to this description, or may be made without departing from the spirit and scope of the invention defined in the appended claims.

What is claimed is:

1. A thermal spray powder composition comprising a blend of a tungsten carbide-cobalt-chromium material and 5 to 35 weight percent of a cobalt alloy.

2. The powder composition claim 1 wherein the blend comprises tungsten carbide-cobalt-chromium and 10 to 30 weight percent of the cobalt alloy.

3. The powder composition of claim 1 wherein the tungsten carbide-cobalt-chromium material comprises tungsten carbide, 5 to 20 weight percent cobalt, and 0 to 12 weight percent chromium.

4. The powder composition of claim 3 wherein the tungsten carbide-cobalt-chromium material comprises tungsten carbide, 8 to 13 weight percent cobalt and 4 to 10 chromium.

5. The powder composition of claim 1 wherein the cobalt alloy comprises in weight percent 25 to 31 chromium, 5 to 11 tungsten, 0.5 to 1.5 carbon, and balance cobalt.

6. The powder composition of claim 5 wherein the cobalt alloy comprises in weight percent cobalt-28 chromium-8 tungsten-1 carbon.

7. The powder composition of claim 1 wherein the cobalt alloy comprises in weight percent 25 to 31 molybdenum, 14 to 20 chromium, 1 to 5 silicon, less than 0.08 carbon, and balance cobalt.

8. The powder composition of claim 1 wherein the cobalt alloy comprises in weight percent cobalt-28 molybdenum-17 chromium-3 silicon-less than 0.08 carbon.

* * * * *